US007759034B2

(12) United States Patent
Nakano

(10) Patent No.: US 7,759,034 B2
(45) Date of Patent: Jul. 20, 2010

(54) ELECTROPHOTOGRAPHIC PHOTOSENSITIVE MEMBER, METHOD OF PRODUCING THE SAME AND IMAGE FORMING APPARATUS

(75) Inventor: Kouichi Nakano, Hakusan (JP)

(73) Assignee: Kyocera Corporation, Kyoto (JP)

( * ) Notice: Subject to any disclaimer, the term of this patent is extended or adjusted under 35 U.S.C. 154(b) by 626 days.

(21) Appl. No.: 11/564,172

(22) Filed: Nov. 28, 2006

(65) Prior Publication Data

US 2007/0134569 A1 Jun. 14, 2007

(30) Foreign Application Priority Data

Nov. 29, 2005 (JP) ..... 2005-344085

(51) Int. Cl.
*G03G 5/10* (2006.01)

(52) U.S. Cl. ..... 430/69; 430/56; 430/127; 430/133; 430/134

(58) Field of Classification Search ..... 430/56, 430/69, 133, 134, 127; 399/159
See application file for complete search history.

(56) References Cited

U.S. PATENT DOCUMENTS

| | | | | |
|---|---|---|---|---|
| 3,652,330 | A * | 3/1972 | Anderson | 430/128 |
| 4,210,710 | A * | 7/1980 | Bixby | 430/56 |
| 5,202,214 | A * | 4/1993 | Kawamorita et al. | 430/133 |
| 5,244,697 | A * | 9/1993 | Vackier et al. | 430/133 |
| 5,415,961 | A * | 5/1995 | Yu et al. | 430/58.05 |
| 5,518,854 | A * | 5/1996 | Yu et al. | 430/133 |
| 5,578,410 | A * | 11/1996 | Petropoulos et al. | 430/133 |
| 6,063,532 | A | 5/2000 | Miyake | |
| 6,221,552 | B1 * | 4/2001 | Street et al. | 430/130 |
| 7,517,629 | B2 * | 4/2009 | Kobayashi et al. | 430/119.71 |
| 2008/0096123 | A1 * | 4/2008 | Shimada et al. | 430/127 |

FOREIGN PATENT DOCUMENTS

| | | |
|---|---|---|
| JP | 56-012648 | 2/1981 |
| JP | 61-169851 (A) | 7/1986 |

(Continued)

OTHER PUBLICATIONS

Japanese language Explanation of Circumstances Concerning Accelerated Examination and its English language translation for corresponding Japanese application 2006318565 lists the references above.

(Continued)

*Primary Examiner*—Christopher RoDee
(74) *Attorney, Agent, or Firm*—Hogan Lovells US LLP

(57) ABSTRACT

The present invention relates to an electrophotographic photosensitive member and an image forming apparatus provided with the electrophotographic photosensitive member. The electrophotographic photosensitive member includes a cylindrical body and a photosensitive layer formed on a circumferential surface of the cylindrical body and including a latent image forming area and a non-latent image forming area. The photosensitive layer includes a stress relaxation portion at the non-latent image forming area for releasing stress applied between the cylindrical body and the photosensitive layer. The present invention further relates to a method of producing the electrophotographic photosensitive member. The producing method includes a first step for forming the photosensitive layer on the circumferential surface of the cylindrical body, and a second step for forming the stress relaxation portion at the non-latent image forming area of the photosensitive layer for releasing stress applied between the cylindrical body and the photosensitive layer.

6 Claims, 8 Drawing Sheets

FOREIGN PATENT DOCUMENTS

| | | | |
|---|---|---|---|
| JP | 63-002067 | | 1/1988 |
| JP | 63-208850 | | 8/1988 |
| JP | 07-019068 | | 1/1995 |
| JP | 08-146625 | | 7/1996 |
| JP | 11065150 | A | 3/1999 |
| JP | 2003262966 | A | 9/2003 |
| JP | 2514198 | B | 11/2008 |

OTHER PUBLICATIONS

Japanese language office action and its English language translation for corresponding Japanese application 2006318565 lists the references above.

* cited by examiner

ELECTROPHOTOGRAPHIC PHOTOSENSITIVE MEMBER, METHOD OF PRODUCING THE SAME AND IMAGE FORMING APPARATUS

CROSS-REFERENCE TO RELATED APPLICATIONS

The present application claims priority under 35 U.S.C. §119 to Japanese Patent Application No. 2005-344085, filed Nov. 29, 2005 entitled "ELECTROPHOTOGRAPHIC PHOTOSENSITIVE MEMBER, METHOD OF PRODUCING THE SAME AND IMAGE FORMING APPARATUS." The contents of this application are incorporated herein by reference in their entirety.

TECHNICAL FIELD

The present invention relates to an electrophotographic photosensitive member, a method of producing the same, and an image forming apparatus.

BACKGROUND ART

An image forming apparatus such as a copying machine and a printer utilizing electrophotographic method is provided with an electrophotographic photosensitive member. In such image forming apparatus, the electrophotographic photosensitive member is rotated by a power transmitter, and synchronously with the rotation, operations such as electrification, exposure, development, transfer, and cleaning are repeated, thereby forming an image on a recording medium.

Specifically, in the image forming apparatus, the electrophotographic photosensitive member is electrically charged at its surface and then rotated while being irradiated by laser light for exposure, according to an image pattern, so that an electrostatic latent image is formed on the surface of the electrophotographic photosensitive member. Next, the latent image is developed by attaching toner to the photosensitive member. The toner attached to the electrophotographic photosensitive member is transferred to a recording medium. After the transfer of toner to the recording medium, the electrophotographic photosensitive member is rotated while a cleaning blade is pressed onto the surface of electrophotographic photosensitive member, so that remaining toner is removed.

An electrophotographic photosensitive member is known which is a combination of a metal body and a photosensitive layer made of Si inorganic material formed on the body.

For forming the photosensitive layer using an inorganic material, a film forming device such as CVD device and sputtering device issued. When forming the photosensitive layer using such devices, generally, the body is heated to an adequately high temperature, e.g. 200° C.-400° C. It is known that the photosensitive layer made in this way may peel off from ends of the body.

It is considered that such peeling of the photosensitive layer is caused due to the difference in rate of thermal expansion of the body and the photosensitive layer. When the body and the photosensitive layer are cooled after the film forming, because of the difference in rate of thermal expansion, the body and the photosensitive layer have different amount of thermal contraction. As a result, a stress is applied between the photosensitive layer and the body, and the stress is trapped within the photosensitive layer. Such internal stress acts largely on the ends of the body where the thermal contraction is the largest, and thus the photosensitive layer peels off from the ends of the body.

The peeled photosensitive layer may stick to a latent image area of the photosensitive layer, which may cause a defective image.

Patent Document 1: JP-B-07-19068

Patent Document 2: JP-B-2514198

DISCLOSURE OF THE INVENTION

An object of the present invention is to prevent a photosensitive layer from peeling off from an electrophotographic photosensitive member, and to prevent a defective image at an image forming apparatus provided with the electrophotographic photosensitive member.

The present invention provides an electrophotographic photosensitive member and an image forming apparatus provided with the electrophotographic photosensitive member.

The electrophotographic photosensitive member includes a cylindrical body and a photosensitive layer formed on the circumferential surface of the cylindrical body and including a latent image forming area and a non-latent image forming area.

The photosensitive layer is provided with a stress relaxation portion at the non-latent image forming area for releasing stress applied between the cylindrical body and the photosensitive layer.

The present invention further relates to a method of producing an electrophotographic photosensitive member. The producing method includes a first step for forming a photosensitive layer on a circumferential surface of a cylindrical body, and a second step for forming a stress relaxation portion at a non-latent image forming area of the photosensitive layer for releasing stress applied between the non-latent image forming area and the cylindrical body.

BEST MODE FOR CARRYING OUT THE INVENTION

An image forming apparatus and an electrophotographic photosensitive member according to the present invention are specifically described below with reference to the accompanying drawings.

Figure 1:
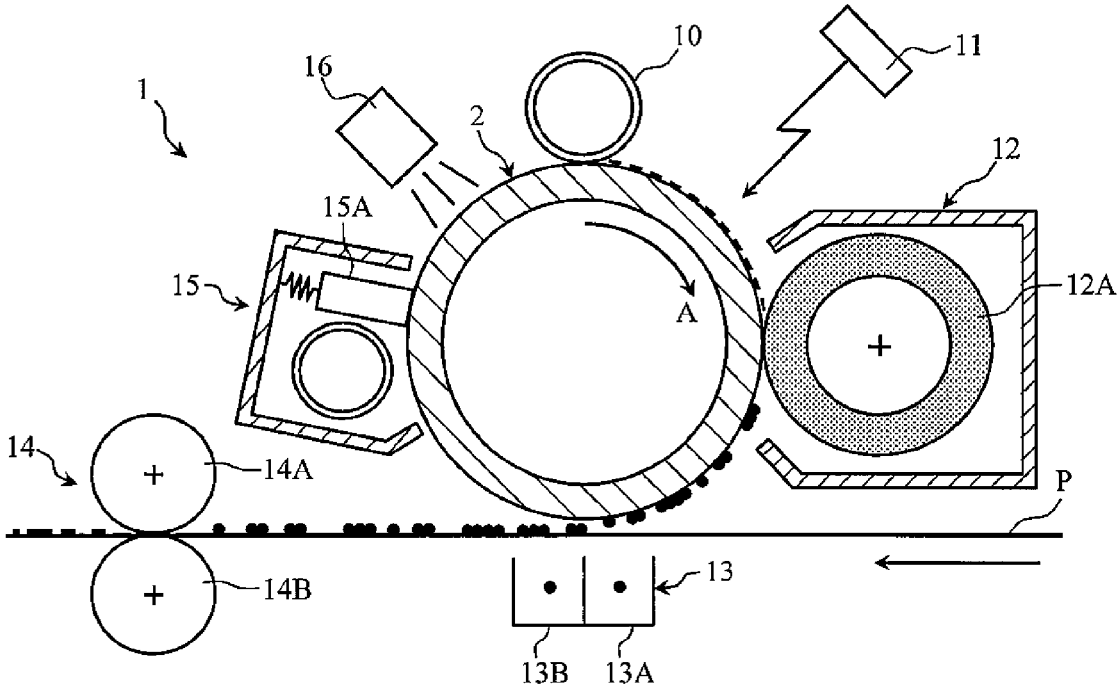
FIG. 1 is a schematic view illustrating an example of an image forming apparatus according to the present invention.

An image forming apparatus 1 shown in FIG. 1 utilizes the Carlson method for image forming, and includes an electrophotographic photosensitive member 2, an electrification mechanism 10, an exposure mechanism 11, a development mechanism 12, a transfer mechanism 13, a fixing mechanism 14, a cleaning mechanism 15, and a discharging mechanism 16.

Figure 2:
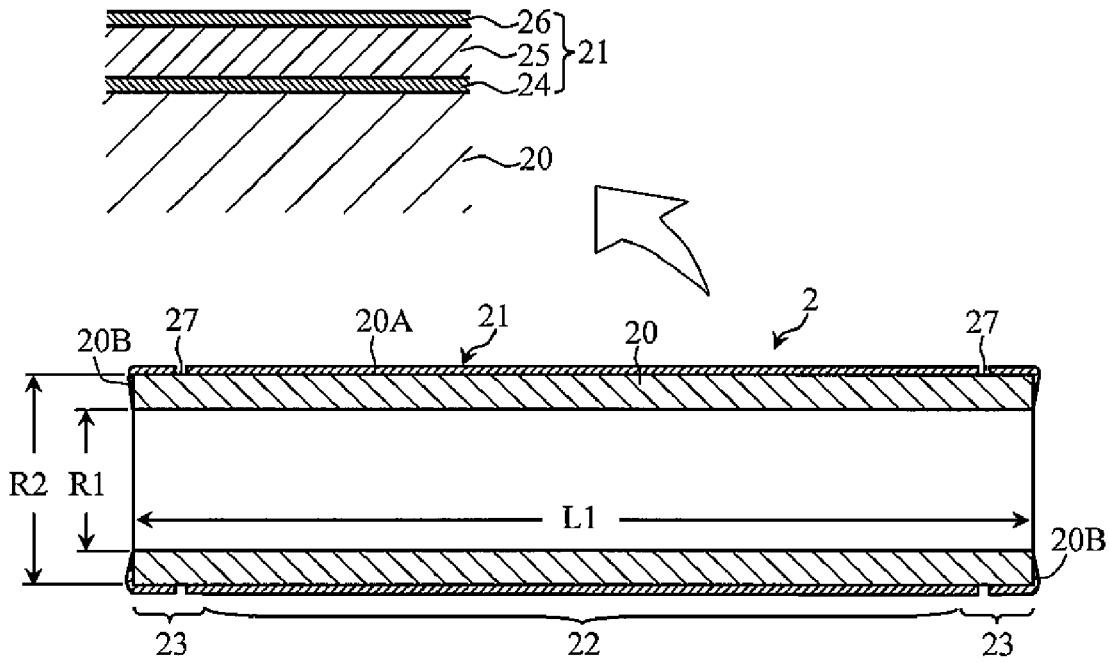
FIG. 2 is a sectional view and an enlarged view of the principal portions, illustrating an electrophotographic photosensitive member according to the present invention.

An electrophotographic photosensitive member 2 forms an electrostatic latent image or a toner image according to an image signal, and can be rotated in the direction of an arrow A in FIG. 1, by a non-illustrated rotation mechanism. As shown in FIG. 2, the electrophotographic photosensitive member 2 includes a cylindrical body 20 and a photosensitive layer 21.

The cylindrical body 20 forms the skeleton of the electrophotographic photosensitive member 2 and holds the electrostatic latent image on its outer circumference. The axis of the cylindrical body 20 has a length L1 slightly longer than the maximum length of a recording medium P such as a recording paper to be used. Specifically, the length L1 of the axis is set so that the cylindrical body 20 extends beyond the ends of the recording medium P by not less than 0.5 cm and not more than 5 cm. Thus, the photosensitive layer 21 includes a latent image forming area 22 corresponding to the maximum length of the recording medium P, and non-latent image forming areas 23 provided at the ends of the cylindrical body, next to the latent image forming area 22. The non-latent image forming areas 23 are areas of the photosensitive layer 21 (at the outside of the latent image forming area 22 in the axial direction) which are never to be used in forming a latent image of any size on the photosensitive layer 21.

Such cylindrical body 20 is conductive at least on its surface. Specifically, the cylindrical body 20 may be made of a conductive material as a whole, or may be made of an insulating material having a conductive film formed thereon. The conductive material for forming the cylindrical body 20 may include metal such as Al or SUS (stainless), Zn, Cu, Fe, Ti, Ni, Cr, Ta, Sn, Au, and Ag, and an alloy of these metals, for example. The insulating material for forming the cylindrical body 20 may include resin, glass, and ceramic. The material for forming the conductive film may include a transparent conductive material such as ITO (Indium Tin Oxide) and $SnO_2$, other than the above-described metals. The transparent conductive material can be deposited on the surface of the insulating cylindrical body, utilizing a conventional method such as vapor deposition.

Preferably, the cylindrical body 20 is formed of Al alloy material (such as Al—Mn alloy, Al—Mg alloy, and Al—Mg—Si alloy, for example) as a whole. In this way, the electrophotographic photosensitive member 2 having a light weight can be made at a low cost, and further, the adhesion between the cylindrical body and an anti-charge injection layer 24 and a photoconductive layer 25, both to be described below, of the photosensitive layer 21 is reliably enhanced when forming the layers 24, 25 by amorphous silicon (a-Si) material.

Such cylindrical body 20 made of Al alloy material can be formed by casting, homogenizing, hot extrusion, and cold drawing, and if necessary, annealing is performed.

The photosensitive layer 21 is formed continuously on a circumferential surface 20A and end surfaces 20B of the cylindrical body 20, with a thickness of not less than 15 μm and not more than 90 μm. By setting the thickness of the photosensitive layer 21 to not less than 15 μm, generation of a fringe pattern on a formed image can be reliably prevented even when a long-wavelength light absorbing layer is not formed, and by setting the thickness of the photosensitive layer 21 to not more than 90 μm, peeling of the layer due to stress can be prevented reliably. The photosensitive layer 21 includes an anti-charge injection layer 24, a photoconductive layer 25, and a surface layer 26 laminated together, and has a stress relaxation portions 27.

Figure 3A:
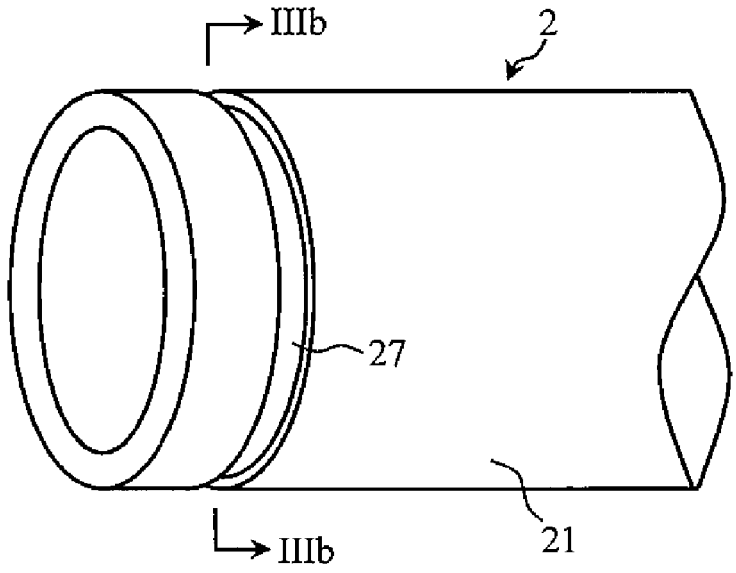
FIG. 3A is a perspective view illustrating an end of the electrophotographic photosensitive member shown in FIG. 2.
Figure 3B:
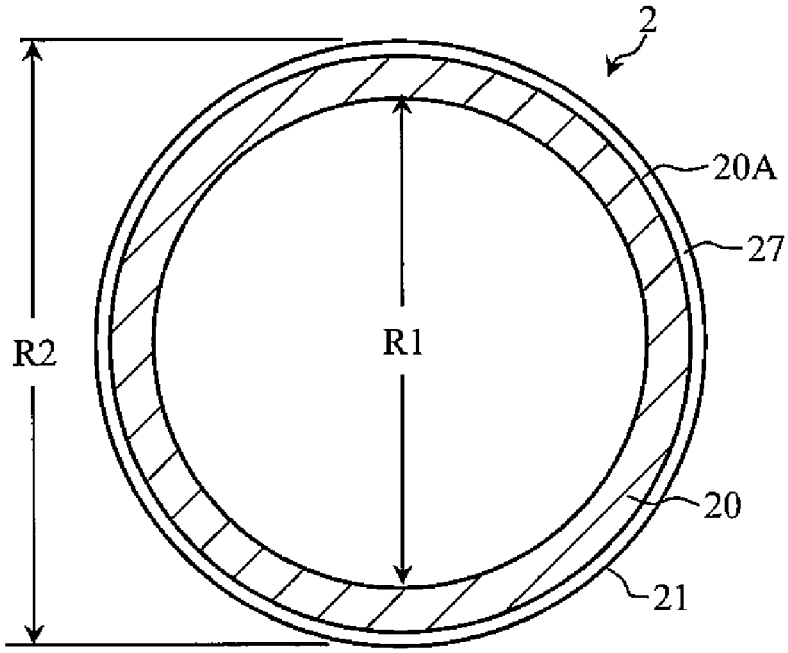
FIG. 3B is a sectional view taken along lines IIIb-IIIb of FIG. 3A.
Figure 4A:
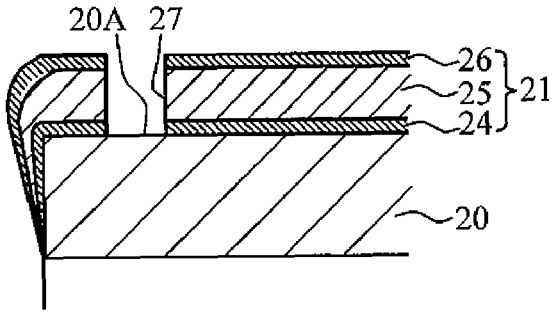
FIGS. 4A-4E are enlarged sectional views each illustrating a stress relaxation portion formed on a photosensitive layer.

The stress relaxation portions 27 serve to reduce the internal stress applied between the photosensitive layer 21 and the cylindrical body 20, and are formed at the non-latent image forming areas 23. As shown in FIGS. 3A and 3B, each of the stress relaxation portions 27 is formed circularly along the circumference of the cylindrical body 20, and as shown in FIG. 4A, is formed to be a rectangular recess in section, from which the surface of the cylindrical body 20 is exposed. In this way, by forming the stress relaxation portions 27 so as to expose the cylindrical body 20, significant stress relaxation effect can be obtained.

As the stress relaxation portions 27 are formed on the photosensitive layer 21 of the electrophotographic photosensitive member 2, the internal stress accumulated in the photosensitive layer 21 is released, and thus the photosensitive layer 21 is prevented from peeling off from the cylindrical body 20. The internal stress tends to be accumulated especially at the ends of the cylindrical body 20. However, the stress relaxation portions 27 formed at the non-latent image forming areas 23 of the photosensitive layer 21 (corresponding to the ends of the cylindrical body 20) properly prevent not only accumulation of the internal stress but also peeling of the photosensitive layer 21, both at the ends of the cylindrical body.

Further, by forming the stress relaxation portions 27 circularly along the circumferences of the cylindrical body 20, the photosensitive layer 21 is prevented from peeling off along the circumference of the cylindrical body 20, thereby preventing the peeling of the photosensitive layer 21 more effectively.

As the photosensitive layer 21 has an adequately large thickness of not less than 15 μm and not more than 90 μm, the internal stress applied to the photosensitive layer 21 is relatively large due to the thickness. However, even with the relatively large internal stress, the photosensitive layer can be prevented from peeling off by forming the stress relaxation portions 27.

Figure 4B:
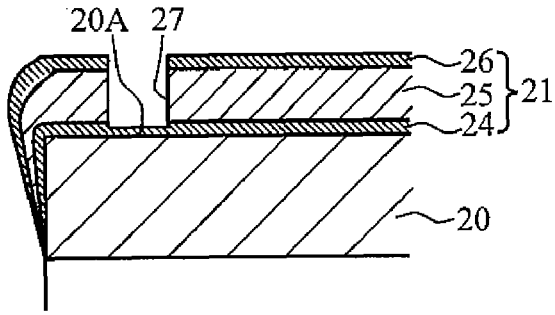
Figure 4C:
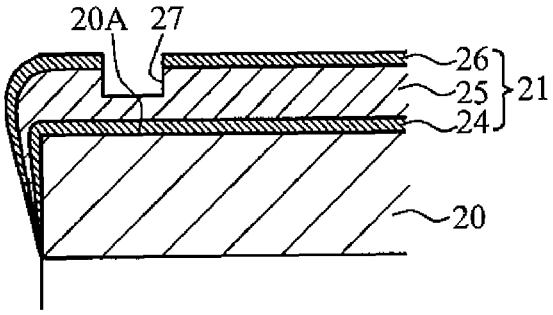
Figure 4D:
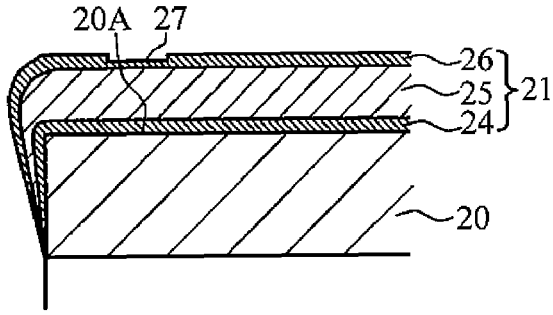
Figure 4E:
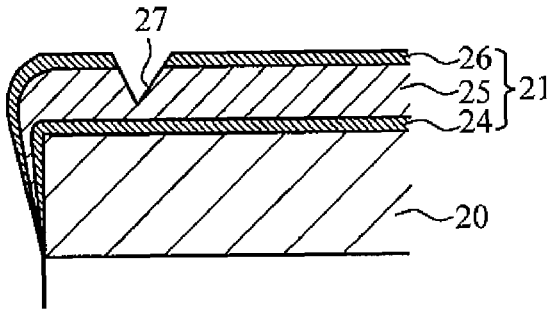

As shown in FIGS. 4B-4D, each of the stress relaxation portions 27 may be formed to have a bottom positioned within the photosensitive layer 21, without exposing the surface of the cylindrical body 20. In FIG. 4B, the stress relaxation portion 27 has a bottom within the anti-charge injection layer 24, in FIG. 4C, the stress relaxation portion 27 has a bottom within the photoconductive layer 25, and in FIG. 4D, the stress relaxation portion 2.7 has a bottom within the surface layer 26. As shown in FIGS. 4B and 4C, when the stress relaxation portion 27 has a bottom within the anti-injection layer 24 or the photoconductive layer 25, the cylindrical body 20 can be prevented from deterioration due to oxidization in comparison with the example exposing the cylindrical body 20, and also can have relatively great stress relaxation effect in comparison with the example in which the stress relaxation portion 27 has a bottom within the surface layer 26 as shown in FIG. 4D. As shown in FIG. 4E, when the stress relaxation portion 27 has a bottom within the surface layer 26, the photoconductive layer 25 is not exposed so that the photoconductive layer 25 and so on are protected by the surface layer 26, thereby enhancing the durability while obtaining the stress relaxation effect.

The stress relaxation portion 27 may also be formed to have a bottom at the boundary face of the anti-charge injection layer 24 and the photoconductive layer 25, or at the boundary face of the photoconductive layer 25 and the surface layer 26. Further, as shown in FIG. 4E, the stress relaxation portion 27 may be formed as a triangular recess in section, or may be, though not shown, a semicircular or semi-elliptic recess in section.

However, in view of proper release of the internal stress between the photosensitive layer 21 and the cylindrical body 20, it is preferable that each of the stress relaxation portions 27 has a great depth. It is most preferable that the stress relaxation portion is formed in a manner that the circumferential surface 20A of the cylindrical body 20 is exposed, as shown in FIG. 4A.

Figure 5A:
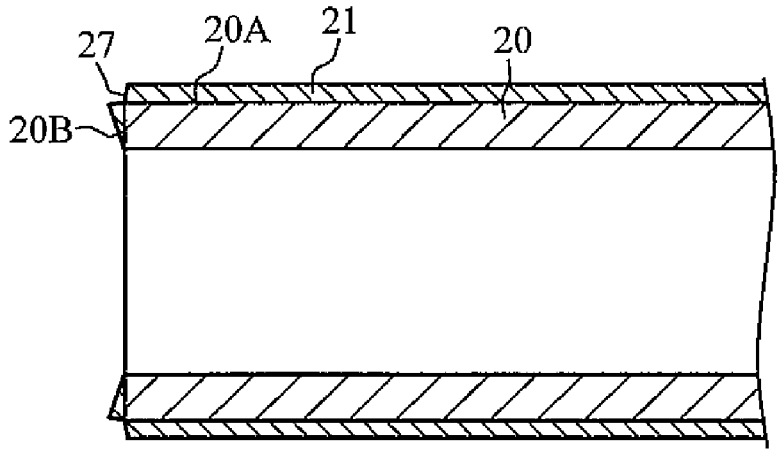
FIGS. 5A-5C are sectional views each illustrating other examples of the stress relaxation portion at an end of the electrophotographic photosensitive member.
Figure 5B:
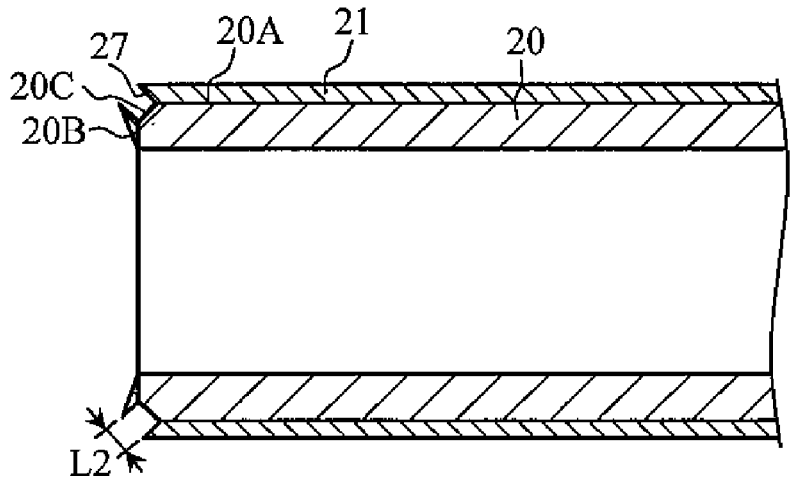

As shown in FIG. 5A, each of the stress relaxation portion 27 may be formed at a position corresponding to a boundary of the circumferential surface 20A and each of the end surfaces 20B, while as shown in FIG. 5B, when a chamfer 20C is formed between the circumferential surface 20A and the end surface 20B of the cylindrical body 20, the stress relaxation portion 27 may be formed at a position corresponding to the chamfer 20C. Though the chamfer 20C is a flat surface in FIG. 5B, the chamfer 20C may be formed as a curved surface.

At the boundary of the circumferential surface 20A and each of the end surfaces 20B of the cylindrical body 20 or at the chamfer 20C formed between the circumferential surface 20A and the end surface 20B, where the photosensitive layer 21 is provided at the corners of the cylindrical body 20, the photosensitive layer 21 tends to peel off. However, by forming the stress relaxation portions 27 at such portions, the photosensitive layer 21 can be properly prevented from peeling off from the cylindrical body 20.

Figure 5C:
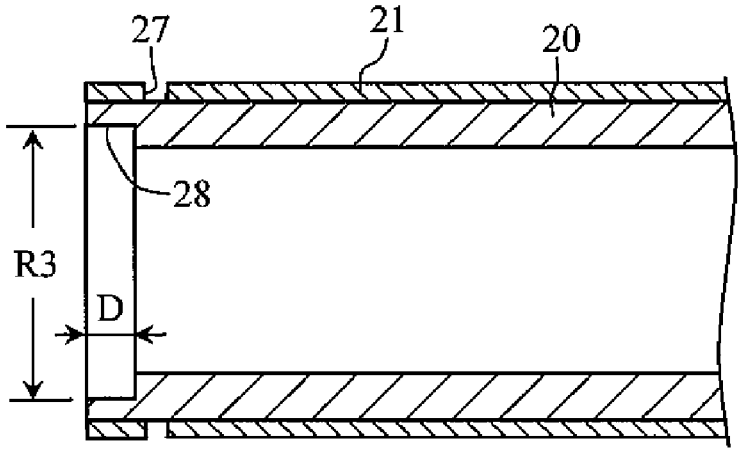

Further, as shown in FIG. 5C, the stress relaxation portion 27 can be formed at the photosensitive layer 21 of a cylindrical body 20 which is provided with an inside low portion 28 in which a drive flange or a bearing flange is fitted in. In FIG. 5C, the stress relaxation portion 27 is formed as shown in FIG. 3, however, the stress relaxation portion 21 may be formed as shown in the other figures.

Figure 6A:
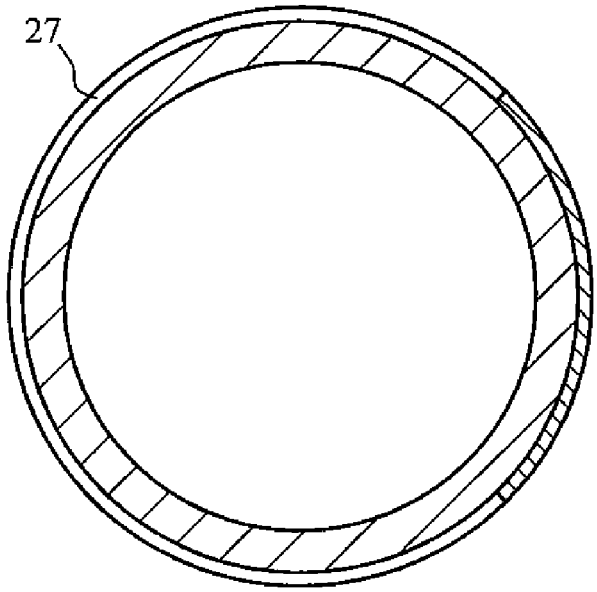
FIGS. 6A and 6B are sectional views corresponding to FIG. 3B, illustrating other examples of the stress relaxation portions.
Figure 6B:
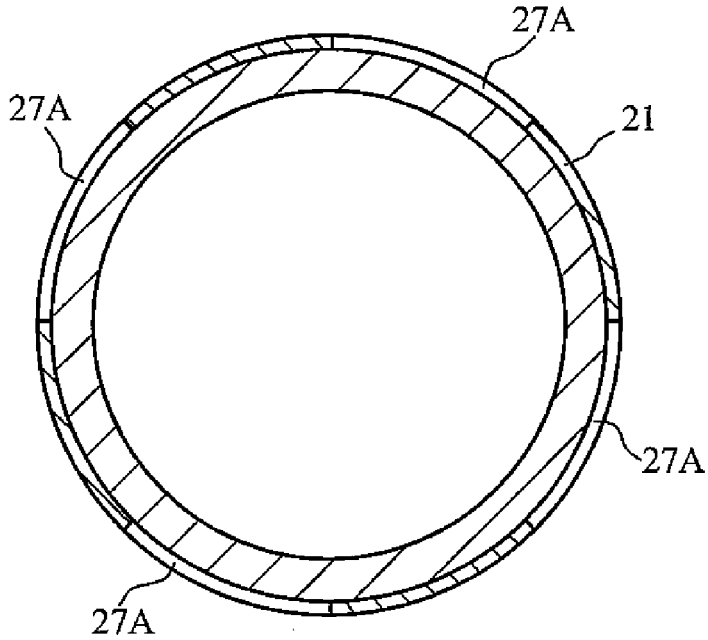

The stress relaxation portion 27 needs not to be formed along the entire circumference of the photosensitive layer 21. As shown in FIG. 6A, for example, the stress relaxation portion 27 may be partly omitted, or as shown in FIG. 6B, a plurality of recesses 27A may be formed discretely on the circumference of the cylindrical body 20. Of course, the stress relaxation portion 27 may be formed in a manner other than the ones shown in FIGS. 6A and 6B.

The anti-charge injection layer 24 shown in FIG. 2 serves to prevent injection of electrons and electron holes from the cylindrical body 20 into the photoconductive layer 25, and has a thickness of not less than 1 μm and not more than 10 μm, for example. Various types of anti-charge injection layer 24 may be used depending on the material of the photoconductive layer 25. For example, when using a-Si material for the photoconductive layer 25, the anti-charge injection layer 24 may also be made of an inorganic material such as a-Si material. In this way, electrophotographic photosensitive property with enhanced adhesiveness between the cylindrical body 20 and the photoconductive layer 25 can be obtained.

In forming the anti-charge injection layer 24 using a-Si material, the material may contain a thirteenth group element of the periodic system (hereinafter referred to as "thirteenth group element") or a fifteenth group element of the periodic system (hereinafter referred to as "fifteenth group element") in an amount larger than those contained in the photoconductive layer 25 of a-Si material so as to determine the conductivity type. Further, a large amount of carbon (C), nitrogen (N), or oxygen (O) may be also contained so as to have high resistivity.

In forming the anti-charge injection layer 24 using an inorganic material as a whole, it can be formed by conventional film formation methods such as glow discharge decomposition method, various sputtering methods, various vapor deposition methods, ECR method, photo-induced CVD method, catalyst CVD method, and reactive vapor deposition method, for example.

Note that the anti-charge injection layer 24 is optional and is not always necessary. The anti-charge injection layer 24 may be replaced with a long-wavelength light absorbing layer. The long-wavelength light absorbing layer prevents a long-wavelength light (light of a wavelength of not less than 0.8 μm) entering on exposure from reflecting on the circumferential surface 20A of the cylindrical body 20, and thus prevents a fringe pattern generated at a formed image.

In the photoconductive layer 25, electrons are excited by a laser irradiation from the exposure mechanism 11, and a carrier of free electrons or electron holes is generated. The photoconductive layer has a thickness of not less than 10 μm and not more than 80 μm, for example. The photoconductive layer 25 is formed of a-Si material, amorphous selenium material such as a-Se, Se—Te, and As2Se3, or chemical compound of twelfth group element and sixteenth group element of the periodic system such as ZnO, CdS, and CdSe, for example. As the a-Si material, a-Si, a-SiC, a-SiN, a-SiO, a-SiGe, a-SiCN, a-SiNO, a-SiCO or a-SiCNO may be used. Especially when the photoconductive layer 25 is made of a-Si, or an a-Si alloy material of a-Si and an element such as C, N, and O, it is able to have high luminous sensitivity, high-speed responsiveness, stable repeatability, high heat resistance, high endurance, and so on, thereby reliably obtaining enhanced electrophotographic property. Further, in addition to the above condition, by forming the surface layer 26 using a-SiC (especially a-SiC:H), conformity of the photoconductive layer with the surface layer 26 is enhanced.

In forming the photoconductive layer 25 using an inorganic material as a whole, it can be formed by conventional film formation methods such as glow discharge decomposition method, various sputtering methods, various vapor deposition methods, ECR method, photo-induced CVD method, catalyst CVD method, and reactive vapor deposition method, for example. In film forming of the photoconductive layer 25, hydrogen (H) or a halogen element (F, Cl) may be contained in the film by not less than one atom % and not more than 40 atom % for dangling-bond termination. Further, in forming the photoconductive layer 25, for obtaining a desired property such as electrical property including e.g. dark conductivity and photoconductivity as well as optical bandgap in respective layers, not less than 0.1 ppm and not more than 20000 ppm of thirteenth group element or fifteenth group element, or not less than 0.01 ppm and not more than 100 ppm of element such as C, N, and 0 may be contained. The elements C, N, and O may be contained such that concentration gradient is generated in the thickness direction of the layers, if the average content of the elements in the layers is within the above-described range.

As the thirteenth group element and the fifteenth group element, in view of high covalence and sensitive change of semiconductor property, as well as of high luminous sensitivity, it is desired to use boron (B) and phosphorus (P). When the thirteenth group element and the fifteenth group element are contained in combination with elements such as C, N, and O, preferably, the thirteenth group element may be contained by not less than 0.1 ppm and not more than 20000 ppm, while the fifteenth group element may be contained by not less than 0.1 ppm and not more than 10000 ppm.

When the photoconductive layer 25 contains none or only a small amount (not less than 0.01 ppm and not more than 100 ppm) of the elements such as C, N, and O, preferably, the thirteenth group element may be contained by not less than 0.1 ppm and not more than 200 ppm, while the fifteenth group element may be contained by not less than 0.01 ppm and not more than 100 ppm. These elements may be contained in a manner that concentration gradient is generated in the thickness direction of the layers, if the average content of the elements in the layers is within the above-described range.

In forming the photoconductive layer 25 using a-Si material, μc-Si (microcrystal silicon) may be contained, which enhances dark conductivity and photoconductivity, and thus advantageously increases design freedom of the photoconductive layer 25. Such μc-Si can be formed by utilizing a method similar to the above-described method, and by changing the film forming condition. For example, when utilizing glow discharge decomposition method, the layer can be formed by setting temperature and high-frequency electricity at the cylindrical body 20 higher than in the case using only a-Si, and by increasing flow amount of hydrogen as diluent gas. Further, impurity elements similar to the above-described elements may be added when μc-Si is contained.

The photoconductive layer 25 may be also formed by changing the above-described inorganic material into particles, and by dispersing the particles in a resin. The photoconductive layer 25 needs not to contain the inorganic material, but may be formed as a photoconductive layer using an organic photoconductive material, for example. The organic photoconductive material includes photoconductive polymer represented by poly-N-vinylcarbazole and low-molecular organic photoconductive material such as 2, 5-bis (p-diethyl aminophenyl)-1, 3, 4-oxadiazol. The organic photoconductive material may be used in combination with various dyestuffs or pigments.

The surface layer 26 is for protecting the photoconductive layer 25 from friction and wear. The surface layer 26 is formed of an inorganic material represented by a-Si material such as a-SiC, and has a thickness of not less than 0.2 μm and not more than 1.5 μm. By making the surface layer 26 to have a thickness of not less than 0.2 μm, flaw in image and variation in density due to wear can be prevented, and by making the surface layer 26 to have a thickness of not more than 1.5 μm, initial characterization (such as defective image due to residual potential) can be improved. Preferably, the thickness of the surface layer 26 may be not less than 0.5 μm and not more than 1.0 μm.

Such surface layer 26 is preferably formed of a-SiC:H in which a-SiC contains hydrogen. Proportion of elements in a-SiC:H can be expressed in a composition formula a-$Si_{1-x}C_x$:H, in which the value of X is not less than 0.55 and less than 0.93, for example. By setting the value X in a range of not less than 0.55 and less than 0.93, a proper hardness for the surface layer 26 can be obtained, and endurance of the surface layer 26 and thus of the electrophotographic photosensitive member 2 can be reliably maintained. Preferably, the value X is set to not less than 0.6 and not more than 0.7. In forming the surface layer 26 using a-SiC:H, H content may be set to about not less than one atom % and not more than 70 atom %. When the H content is set within the above range, Si—H binding is lower than Si—C binding, electrical charge trap generated by light irradiation on the surface of the surface layer 26 can be controlled, thereby suitably preventing residual potential. According to the knowledge of the inventors, by setting the H content to not more than about 45 atom %, more favorable result can be obtained.

In forming the surface layer 26 using an inorganic material as a whole, similarly to the formation of the photoconductive layer 25 using a-Si material, such surface layer 26 of a-SiC:H can be formed by conventional film formation methods such as glow discharge decomposition method, various sputtering methods, various vapor deposition methods, ECR method, photo-induced CVD method, catalyst CVD method, or reactive vapor deposition method, for example.

Further, when the photoconductive layer 25 is formed using organic photoconductive material, the surface layer 26 is normally formed of an organic material. The organic material may be a hardening resin, for example. Examples of the hardening resin include acrylic resin, phenol resin, epoxy resin, silicon resin, and urethane resin.

Next, producing method of the electrophotographic photosensitive member 2 is described below.

The electrophotographic photosensitive member 2 can be produced by a first step for forming the photosensitive layer 21 on the cylindrical body 20, and by a second step for forming the stress relaxation portion 27 at the non-latent image forming area 23 of the photosensitive layer 21.

Figure 7:
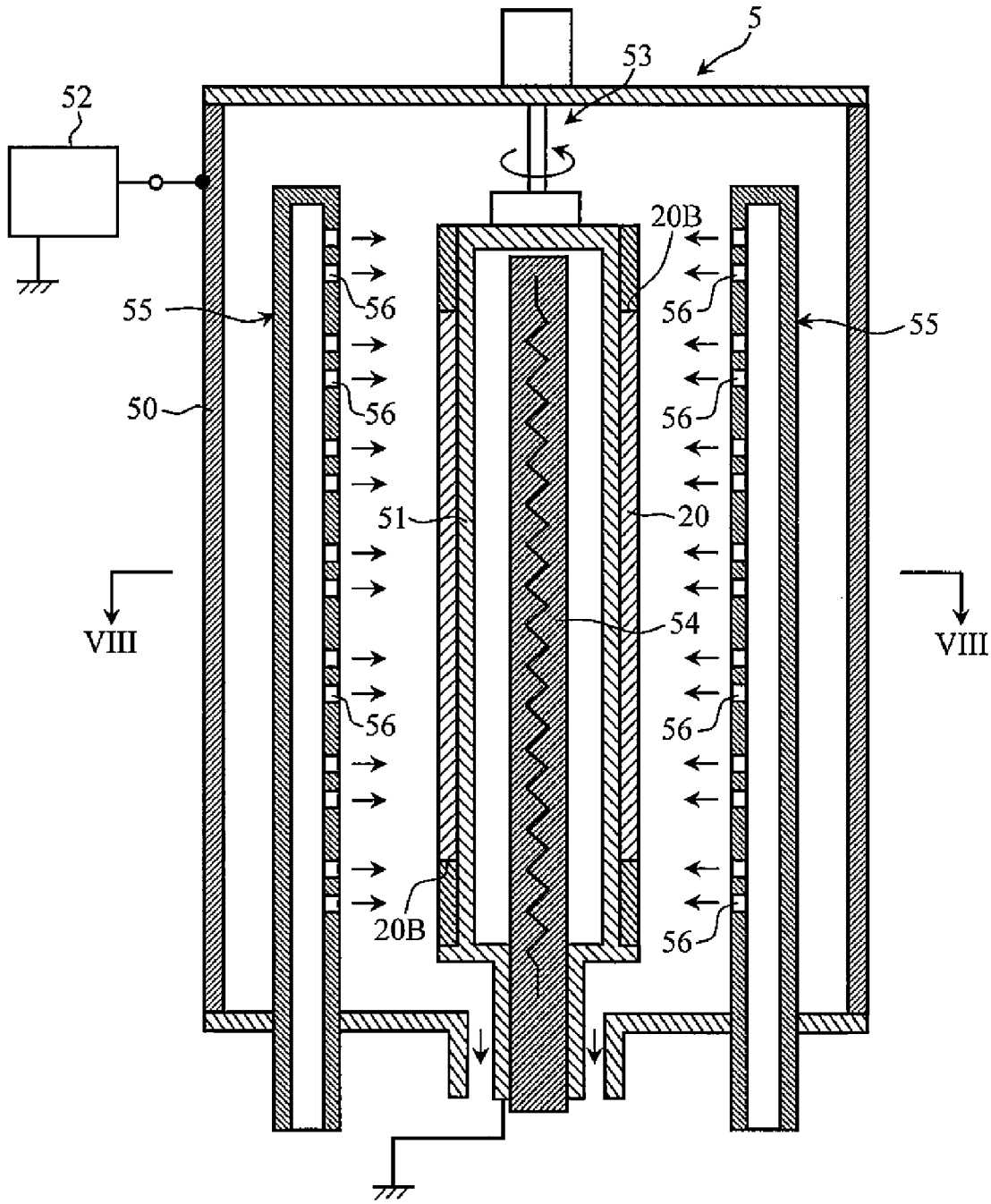
FIG. 7 is a sectional view illustrating a glow discharge decomposition device for forming the photosensitive layer of the electrophotographic photosensitive member.
Figure 8:
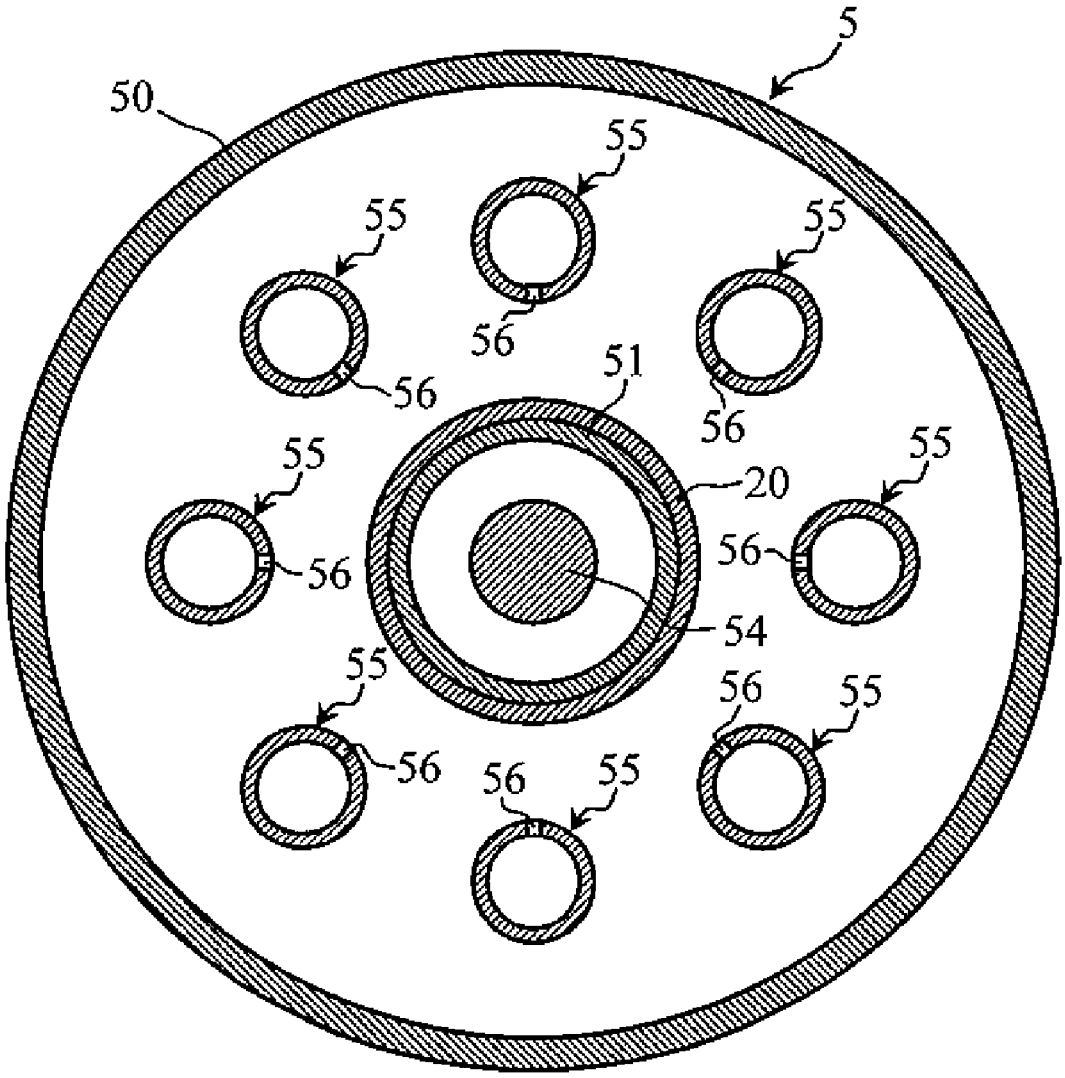
FIG. 8 is a sectional view taken along lines VIII-VIII of FIG. 7.

In the first step, when the entire photosensitive layer 21 is made of an inorganic material, a glow discharge decomposition device 5 shown in FIGS. 7 and 8 can be utilized, for example. The illustrated glow discharge decomposition device 5 includes a cylindrical vacuum container 50 having an intermediate portion provided with a supporting member 51 for supporting the cylindrical body 20. By glow discharge plasma, a-Si film is formed on the cylindrical body 20. In the glow discharge decomposition device 5, the supporting member 51 is grounded and the vacuum container 50 is connected to a high-frequency power source 52 for applying high-frequency power between the vacuum container 50 and the supporting member 51 (cylindrical body 20). The supporting member 51 can be rotated by a rotating mechanism 53, and heated by a heater 54 provided therein. The glow discharge decomposition device 5 further includes a plurality (eight in the figure) of gas inlet tubes 55 surrounding the supporting member 51 (cylindrical body 20). Each of the gas inlet tubes 55 is provided with a plurality of gas inlet ports 56 aligned in the axial direction. The gas inlet ports 56 of the gas inlet tube 55 are positioned to face the cylindrical body 20, so that material gas introduced through the gas inlet ports 56 is blew out toward the cylindrical body 20.

In forming a-Si film on the cylindrical body 20 using the glow discharge decomposition device 5, material gas of predetermined amount and gas ratio is introduced into the cylindrical body 20 through the gas inlet ports 56 of the gas inlet tubes 55. Here, the cylindrical body 20 together with the supporting member 51 is rotated by the rotating mechanism 53. The high-frequency power source 52 applies high-frequency power between the vacuum container 50 and the supporting member 51 (cylindrical body 20), and glow discharge is performed to decompose the material gas, so that a-Si film is formed on the cylindrical body 20 which is set at a desired temperature.

In other words, the temperature of the supporting member 51 and the cylindrical body 20 is controlled by the heater 54, while setting the gas pressure, gas composition, and film forming time properly, thereby forming the photosensitive layer 21 including the above-described anti-charge injection layer 24, photoconductive layer 25, and surface layer 26.

By using the gas inlet tubes 55 provided with gas inlet ports 56 positioned above and below the end surfaces 20B of the cylindrical body 20, for example, the material gas can surround the end surfaces 20B of the cylindrical body 20, so that the photosensitive layer 21 is formed continuously on the circumferential surface 20A and the end surfaces 20B of the cylindrical body 20. Though not illustrated, gas inlet tubes may be additionally provided in a manner that their gas inlet ports can be arranged to face the chamfers 20C (see FIG. 5B) and the end surfaces 20B of the cylindrical body 20. By forming the photosensitive layer 21 on the end surfaces 20B, the photosensitive layer 21 is prevented from having a small thickness at the ends of the circumferential surface 20A, and the photosensitive layer 21 is formed to have a constant thickness on the circumferential surface 20A. By forming the photosensitive layer 21 with a constant thickness, the thickness of the photosensitive layer 21 is also constant at the latent image forming area 22 (see FIG. 2), which prevents variation in the charging ability of the photosensitive member at the photosensitive layer 21 in the axial direction, thereby preventing variation in electrophotographic property.

The second step is for forming recesses at the cylindrical body 20 on which the photosensitive layer 21 is formed, by utilizing the methods (1)-(8) described below, for example.

(1) Forming recesses by applying force to peel a part of the photosensitive layer 21, using a tool. A tool with a sharp edge such as a metal needle (wimble) and a punch may be used.

(2) Forming recesses by applying load at the cylindrical body 20 to crack the photosensitive layer 21 and remove the cracked part and its vicinity of the photosensitive layer 21. The load is applied to inside of the end portion of the cylindrical body 20, such as the inside low portion (see FIG. 5C), for example. In this way, the ends of the cylindrical body 20 are deformed and the photosensitive layer 21 is cracked, so that the recesses are formed by removing the cracked part and its vicinity of the photosensitive layer 21.

(3) Forming recesses by cutting off a part of the photosensitive layer 21 with a cutting tool. Specifically, a cutting tool such as a cutter is used to cut a part of the photosensitive layer 21, or a cutting tool such as a lathe is used to cut a part of the photosensitive layer 21 with a diamond turning tool while the electrophotographic photosensitive member 2 is rotated.

(4) Forming recesses by grinding the photosensitive layer 21 using hard abrasive grains. Specifically, a grinding machine or a lapping machine is used for grinding and removing a part of the photosensitive layer 21, or sandpaper or lapping film is used to scrape off a part of the photosensitive layer 21.

(5) Forming recesses by cutting off (burning off) a part of the photosensitive layer utilizing heat energy. As the heat energy, laser light can be used.

(6) Forming recesses by performing wet etching on the photosensitive layer 21 using etching liquid. Examples of the etching liquid include a strong acid such as mixture of hydrofluoric acid and nitric acid, and a strong alkali such as sodium hydroxide solution.

(7) Forming recesses by performing discharge etching on the photosensitive layer 21 using fluoride gas or rare gas. Specifically, plasma is generated by applying a voltage while $CF_4$ gas, $ClF_3$ gas, or Ar gas flows into a decompression reactor, so that a part of the photosensitive layer 21 is removed by etching.

(8) Forming recesses by heating and then rapidly cooling the cylindrical body 20 and the photosensitive layer 21 for rapid contraction to crack the photosensitive layer 21, and by removing the cracked part of the photosensitive layer 21. The rapid cooling of the electrophotographic photosensitive member 2 is performed by, for example, pouring cooled nitrogen or the like into a heated reactor holding the electrophotographic photosensitive member 2, or by pouring cooling water into a member of the reactor.

Position, depth, and number of the recesses are optionally determined. The above-described forming methods of the stress relaxation portions 27 are only examples, and other method can be utilized to form the stress relaxation portions 27.

By such producing method, the stress relaxation portions 27 are made in the second step, so that the internal stress of the photosensitive layer 21 is released in advance of using the electrophotographic photosensitive member 2. This prevents a defective image that may be caused when a part of the photosensitive layer 21 is peeled off during use of the image forming apparatus 1 and the peeled part of the photosensitive layer 21 sticks to the other part of the photosensitive layer 21.

The electrification mechanism 10 shown in FIG. 1 uniformly charges the surface of the electrophotographic photosensitive member 2, positively and negatively at about a range of not less than 200 V and not more than 1000 V, according to the type of the photoconductive layer of the electrophotographic photosensitive member 2. The electrification mechanism 10 is arranged in pressing contact with the electrophotographic photosensitive member 2, and is made by coating a cored bar with conductive rubber and PVDF (polyvinylidene fluoride).

The electrification mechanism 10 may be a corotoron for corona discharge. Such electrification mechanism 10 includes a discharging wire stretched in the axial direction of the electrophotographic photosensitive member 2.

The exposure mechanism 11 serves to form an electrostatic latent image on the electrophotographic photosensitive member 2, and is capable of emitting light of a predetermined wavelength (not less than 650 nm and not more than 780 nm, for example). The exposure mechanism 11 forms an electrostatic latent image which is an electric potential contrast by emitting light on the surface of the electrophotographic photosensitive member 2 according to an image signal, and lowering the electrical potential at the emitted portion. An example of the exposure mechanism 11 includes a LED head in which LED elements capable of emitting light at a wavelength of e.g. about 680 nm are arranged at 600 dpi.

Of course, the exposure mechanism 11 may be capable of emitting laser light. By replacing the exposure mechanism 11 having LED head with an optical system using e.g. laser light or a polygon mirror or with an optical system using e.g. a lens or a mirror through which light reflected at paper is transmitted, the image forming apparatus may have a function of a copying apparatus.

The development mechanism 12 forms a toner image by developing the electrostatic latent image formed on the electrophotographic photosensitive member 2. The development mechanism 12 includes a magnetic roller 12A for magnetically holding developer (toner), and a wheel (not shown) or a so-called skid for adjusting a distance (gap) from the electrophotographic photosensitive member 2.

The developer serves to develop a toner image formed on the surface of the electrophotographic photosensitive member 2, and is frictionally charged at the development mechanism 12. The developer may be a binary developer of magnetic carrier and insulating toner, or a one-component developer of magnetic toner.

The magnetic roller 12A serves to transfer the developer to the surface (developing area) of the electrophotographic photosensitive member 2.

In the development mechanism 12, the toner frictionally charged by the magnetic roller 12A is transferred in a form of magnetic brush with bristles each having a predetermined length. On the developing area of the electrophotographic photosensitive member 2, the toner is caused to stick to the surface of the photosensitive member by electrostatic attraction between the toner and the electrostatic latent image, and becomes visible. When the toner image is formed by regular developing, the toner image is charged in the reverse polarity of the polarity of the surface of the electrophotographic photosensitive member 2. On the other hand, when the toner image is formed by reverse developing, the toner image is charged in the same polarity as the polarity of the surface of the electrophotographic photosensitive member 2.

Though the development mechanism 12 utilizes dry developing method, wet developing method using liquid developer may be utilized.

The transfer mechanism 13 transfers the toner image of the electrophotographic photosensitive member 2 on a recording medium P supplied to a transfer area between the electrophotographic photosensitive member 2 and the transfer mechanism 13. The transfer mechanism 13 includes a transfer charger 13A and a separation charger 13B. In the transfer mechanism 13, the rear side (non-recording surface) of the recording medium P is charged in the reverse polarity of the toner image by the transfer charger 13A, and by the electrostatic attraction between this electrification charge and the toner image, the toner image is transferred on the recording medium P. Further, in the transfer mechanism 13, simultaneously with the transfer of the toner image, the rear side of the recording medium P is charged in alternating polarity by the separation charger 13B, so that the recording medium P is quickly separated from the surface of the electrophotographic photosensitive member 2.

As the transfer mechanism 13, a transfer roller driven with the rotation of the electrophotographic photosensitive member 2, and being spaced from the electrophotographic photosensitive member 2 by a minute gap (generally, not more than 0.5 mm) may be used. Such transfer roller applies a transfer voltage to the recording medium P, using e.g. direct-current power source, for attracting the toner image of the electrophotographic photosensitive member 2 onto the recording medium. In using the transfer roller, a separation member such as the separation charger 13B is omitted.

The fixing mechanism 14 serves to fix a toner image, which is transferred on the recording medium P, onto the recording medium P, and includes a pair of fixing rollers 14A, 14B. Each of the fixing rollers 14A, 14B is, for example, a metal roller coated by Teflon (registered trademark). In the fixing mechanism 14, the recording medium P passes through between the fixing rollers 14A, 14B, so that the toner image is fixed on the recording medium P by heat or pressure.

The cleaning mechanism 15 serves to remove the toner remaining on the surface of the electrophotographic photosensitive member 2, and includes a cleaning blade 15A.

The cleaning blade 15A serves to scrape the remaining toner off the surface of the surface layer 26 (see FIG. 2) of the electrophotographic photosensitive member 2. The cleaning blade 15A is made of a rubber material mainly containing polyurethane resin, for example, and has a thickness of not less than 1.0 mm and not more than 1.2 mm at its tip portion in contact with the surface layer 26 (see FIG. 2), a linear pressure of 14 gf/cm (generally not less than 5 gf/cm and not more than 30 gf/cm), and a JIS hardness of 74 degrees (preferably not less than 67 degrees and not more than 84 degrees).

The discharging mechanism 16 removes surface charge on the electrophotographic photosensitive member 2. The discharging mechanism 16 irradiates the whole surface (the surface layer 26) of the electrophotographic photosensitive member 2 by a light source such as LED, and removes the surface charge (remaining electrostatic latent image) of the electrophotographic photosensitive member 2.

In such image forming apparatus 1, by using the electrophotographic photosensitive member 2 in which peeling of the photosensitive layer 21 due to accumulation of the internal stress is prevented, the defective image caused by sticking of the peeled photosensitive layer 21 onto the latent image forming area 22 can be prevented.

EXAMPLE

In the present example, the effect of the stress relaxation portion of the electrophotographic photosensitive member against the peeling of the photosensitive layer and on the image property was studied in running tests.

(Producing of Electrophotographic Photosensitive Members)

The electrophotographic photosensitive members were manufactured using cylindrical bodies illustrated in Table 1 described below. Each of the cylindrical bodies was provided with the photosensitive layer (including anti-charge injection layer, photoconductive layer, and surface layer) utilizing the film forming method illustrated in FIGS. 7 and 8. The photosensitive layer was provided with the stress relaxation portions. For comparison, electrophotographic photosensitive members with no stress relaxation portion were also manufactured.

TABLE 1

Conditions of cylindrical bodies

| | Electrophotographic photosensitive member A | Electrophotographic photosensitive member B |
|---|---|---|
| Material | aluminum alloy | aluminum alloy |
| Alloy number | JIS H4040 5052 | JIS H4040 3003 |
| Inner dimension R1 [mm] | 74 | 27 |
| Outer Dimension R2 [mm] | 80 | 30 |
| Length L1 [mm] | 350 | 255 |
| Chamfer dimension L2 [mm] | 0.3 | zero |
| Inside low portion | formed | none |
| Internal dimension of Inside low portion R3 [mm] | 75.7 | — |
| Depth of Inside low portion D [mm] | 7 | — |

See FIG. 2 for R1, R2, and L1, FIG. 5B for L2, and FIG. 5C for R3 and D.

TABLE 2

Forming condition of the electrophotographic photosensitive member A

| | Anti-charge injection layer | Photoconductive layer | Surface layer |
|---|---|---|---|
| Body supporting member temperature [° C.] | 250 | 250 | 260 |
| Gas pressure [Pa] | 60 | 76 | 73 |
| 13.56 Hz RF electric power [W] | 110 | 125 | 160 |
| Film forming time [min] | 90 | 600 | 70 |
| $SiH_4$ flow amount [sccm] | 90 | 100 | 40 |
| $CH_4$ flow amount [sccm] | — | — | 230 |
| $B_2H_6$ flow amount [sccm] | 0.1 | 0.0002 | — |
| NO flow amount [sccm] | 10 | — | — |
| He flow amount [sccm] | — | — | 290 |
| $H_2$ flow amount [sccm] | — | 130 | — |

The amount of each gas is the absolute amount introduced into the apparatus.

TABLE 3

| Forming condition of the electrophotographic photosensitive member B | | | |
|---|---|---|---|
| | Anti-charge injection layer | Photoconductive layer | Surface layer |
| Body supporting member temperature [° C.] | 280 | 280 | 300 |
| Gas pressure [Pa] | 57 | 60 | 47 |
| 13.56 Hz RF electric power [W] | 170 | 360 | 140 |
| Film forming time [min] | 140 | 220 | 160 |
| $SiH_4$ flow amount [sccm] | 160 | 300 | 8 |
| $CH_4$ flow amount [sccm] | — | — | 370 |
| $B_2H_6$ flow amount [sccm] | 0.13 | 0.0006 | — |
| NO flow amount [sccm] | 15 | — | — |
| He flow amount [sccm] | — | — | — |
| $H_2$ flow amount [sccm] | — | 240 | 300 |

The amount of each gas was the absolute amount introduced into the apparatus.

The stress relaxation portions were formed at positions of the electrophotographic photosensitive members A, B as shown in Table 4 described below. Reference characters A-1 to A-7 in Table 4 indicate examples of the electrophotographic photosensitive member A, while reference characters B-1 to B-3 indicate examples of the electrophotographic photosensitive member B. Specifically, A-7 and B-3 are comparative examples of the electrophotographic photosensitive members with no stress relaxation portions.

In the Table 4, "partly" means the stress relaxation portion was formed to have a bottom positioned within the photosensitive layer, while "entirely" means the stress relaxation portion was formed in a manner that the surface of the cylindrical body or the chamfer was exposed.

A-1 is an electrophotographic photosensitive member with stress relaxation portions formed by pressing the inner surface of the inside low portion to deform the end portions of the cylindrical body and partly remove the photosensitive layer. A-2 is an electrophotographic photosensitive member with stress relaxation portions formed by scraping the photosensitive layer using sandpaper. A-3 is an electrophotographic photosensitive member with stress relaxation portions formed by cutting and removing the photosensitive layer using a lathe cutting tool. A-4 is an electrophotographic photosensitive member with stress relaxation portions formed by cutting the photosensitive layer by pressing a metal needle (wimble) thereon. A-5 is an electrophotographic photosensitive member with stress relaxation portions formed by cutting the photosensitive layer using a cutter. A-6 is an electrophotographic photosensitive member with stress relaxation portions formed by causing the photosensitive layer to partly melt, using mixture of hydrofluoric acid and nitric acid. B-1, B-2 are an electrophotographic photosensitive members with stress relaxation portions formed by grinding and removing the photosensitive layer using a lapping machine.

(Running Test)

As the running test, duration tests were performed by printing 300 thousand sheets of A4 size office paper using an image forming apparatus (KM-C870: manufactured by KYOCERA MITA CORPORATION) provided with the electrophotographic photosensitive member A and an image forming apparatus (LS-2000D: manufactured by KYOCERA MITA CORPORATION) provided with the electrophotographic photosensitive member B. The results of the duration tests were respectively indicated as "o" when no peeling of the photosensitive layer nor defective image was found, and as "x" when any peeling of the photosensitive layer or defective image was found, which may cause a practical problem. The results are shown in the Table 4.

For each of the electrophotographic photosensitive members A (A-1-A-7), the running test were performed with a heater provided inside the cylindrical body for heating the electrophotographic photosensitive member to about 35-40° C. to stabilize its photoconductivity, under an environment with the room temperature of 10° C. and humidity of 20%. For the electrophotographic photosensitive members B (B-1-B-3), the running tests were performed without a heater, under an environment with the room temperature of 23° C. and humidity of 70%.

TABLE 4

| Conditions and running test results of stress relaxation portions of the electrophotographic photosensitive members | | | | |
|---|---|---|---|---|
| | Chamfer | Boundary | Surface Ends | Evaluation |
| A-1 | Partly | — | None | o |
| A-2 | Partly | — | None | o |
| A-3 | None | — | Partly | o |
| A-4 | Partly | — | None | o |
| A-5 | Partly | — | Partly | o |
| A-6 | Partly | — | Partly | o |
| A-7 | None | — | None | x |
| B-1 | — | Partly | Partly | o |
| B-2 | — | Entirely | Partly | o |
| B-3 | — | None | None | x |

See the reference character 20C of FIG. 5B for the chamfer, and see FIG. 5A for the boundary.

As can be seen from the Table 4, in the electrophotographic photosensitive members A-1, A-2, A-3, A-4, A-5, A-6 and the electrophotographic photosensitive members B-1, B-2 provided with the stress relaxation portions, regardless of which one of chamfer, boundary, and surface ends, is provided with the stress relaxation portion, or regardless of whether each of the stress relaxation portions has a bottom within the photosensitive layer or whether the cylindrical body is exposed from the stress relaxation portion, no peeling of the photosensitive layer nor defective image was caused. On the other hand, in the electrophotographic photosensitive members A-7, B-3 with no stress relaxation portions, peeling of the photosensitive layer was caused, and a defective image which may be practically a problem was caused.

As a result, it was proved that the stress relaxation portions formed at the electrophotographic photosensitive member prevent peeling of the photosensitive layer and a defective image.

The invention claimed is:

1. An electrophotographic photosensitive member comprising:

a cylindrical body including a chamfer formed between a circumferential surface and an end surface; and a photosensitive layer formed on the circumferential surface of the cylindrical body and including a latent image forming area and a non-latent image forming area;

wherein the photosensitive layer includes a stress relaxation portion for releasing stress applied between the cylindrical body and the photosensitive layer, the stress relaxation portion being formed at a position corresponding to the chamfer of the non-latent image forming area, the stress relaxation portion includes a plurality of recesses arranged discretely along the circumferential surface of the cylindrical body, and the cylindrical body is exposed at the recesses.

2. The electrophotographic photosensitive member according to claim 1, wherein the cylindrical body is made of a metal, and the photosensitive layer contains an inorganic material.

3. The electrophotographic photosensitive member according to claim 1, wherein the photosensitive layer has a thickness of not less than 15 μm and not more than 90 μm.

4. An image forming apparatus comprising an electrophotographic photosensitive member;

wherein the electrophotographic photosensitive member comprises a cylindrical body including a chamfer formed between the circumferential surface and an end surface; and a photosensitive layer formed on a circumferential surface of the cylindrical body and including a latent image forming area and a non-latent image forming area;

wherein the photosensitive layer includes a stress relaxation portion for releasing stress applied between the cylindrical body and the photosensitive layer, the stress relaxation portion being formed at a position corresponding to the chamfer of the non-latent image forming area, the stress relaxation portion includes a plurality of recesses arranged discretely along the circumference of the cylindrical body, and the cylindrical body is exposed at the recesses.

5. The image forming apparatus according to claim 4, wherein the cylindrical body is made of a metal, and the photosensitive layer contains an inorganic material.

6. The image forming apparatus according to claim 4, wherein the photosensitive layer has a thickness of not less than 15 μm and not more than 90 μm.

* * * * *